US006422423B1

(12) United States Patent
Rho

(10) Patent No.: US 6,422,423 B1
(45) Date of Patent: Jul. 23, 2002

(54) CAP FOR LIQUID CONTAINERS

(76) Inventor: Hee Kwon Rho, 164-6 Kisan-li, Taean-eup, Hwaseong-kun, Kyungki-do (KR)

( * ) Notice: Subject to any disclaimer, the term of this patent is extended or adjusted under 35 U.S.C. 154(b) by 0 days.

(21) Appl. No.: 09/878,400

(22) Filed: Jun. 12, 2001

(30) Foreign Application Priority Data

Sep. 30, 2000 (KR) ..... 2000-57671

(51) Int. Cl.[7] ..... B67D 3/00
(52) U.S. Cl. ..... 222/111; 222/482
(58) Field of Search ..... 222/111, 482, 222/481.5

(56) References Cited

U.S. PATENT DOCUMENTS

| | | | | | |
|---|---|---|---|---|---|
| 161,364 | A | * | 3/1875 | Wagner | 222/111 |
| 721,299 | A | * | 2/1903 | Hartog | 222/482 |
| 1,411,283 | A | * | 4/1922 | Lackner | 222/482 |
| 1,913,393 | A | * | 6/1933 | Jones | 222/482 |
| 2,286,906 | A | * | 6/1942 | Gaines | 222/482 |
| 2,700,484 | A | * | 1/1955 | Rathsprecher | 222/482 |
| 3,782,610 | A | * | 1/1974 | Gilbert | 222/482 X |
| 4,241,855 | A | * | 12/1980 | Yoshioka | 222/482 X |
| 5,850,953 | A | * | 12/1998 | Dallas, Jr. | 222/111 X |

* cited by examiner

*Primary Examiner*—Kenneth Bomberg
(74) *Attorney, Agent, or Firm*—Birch, Stewart, Kolasch & Birch, LLP

(57) ABSTRACT

The object of this invention is to provide a cap for liquid containers. The cap consists of a mounting part mounted to the mouth of a container, a liquid discharging part extending from the top of the mounting part upwardly. In this liquid discharging part, a liquid outlet opening and an air inlet opening are formed at opposite positions of the sidewall, while a partition wall extends from the top wall downward, thus partitioning the interior of the part into a liquid passage and an air passage. An openable top cover, connected to a side of the mounting part, covers the liquid discharging part. When liquid is discharged from the container through the liquid outlet opening, atmospheric air is smoothly introduced into the container through the air inlet opening without causing uneven flow or violent gush of the outlet liquid.

10 Claims, 4 Drawing Sheets

CAP FOR LIQUID CONTAINERS

TECHNICAL FIELD

The present invention relates, in general, to a cap set on the mouth of a liquid container so as to open or close the mouth as desired and, more particularly, to a cap designed to allow atmospheric air to be introduced into the liquid container through the cap when liquid is discharged from the container through the cap.

BACKGROUND ART

As well known to those skilled in the art, a conventional cap for liquid containers is designed in that it is normally tightened to the single mouth of a liquid container to close the mouth, and is selectively removed from the mouth to open the mouth when it is desired to discharge liquid from the container. After the cap is removed from the mouth of the container, the container is properly leaned to a side so as to allow a desired amount of liquid to be discharged from the container through the open mouth. When liquid is discharged from the container through the open mouth as described above, negative pressure corresponding to the volume of discharged liquid is formed within the container. In order to compensate for the negative pressure within the container, atmospheric air is continuously introduced into the container through the same mouth during such a liquid discharging action. However, the mouth of the container provides only one passage, and so discharged liquid unevenly flows out of the mouth and gushes violently since it inevitably encounters atmospheric air current flowing into the container through the same mouth. Therefore, people sometimes fail to smoothly discharge liquid from the mouth of the container into a desired cup, but may spill some liquid outside the cup.

In an effort to overcome the above-mentioned problem experienced while discharging liquid from the mouth of a conventional liquid container, another liquid container, designed to prevent such an encounter of outlet liquid with inlet atmospheric air within the mouth and to prevent uneven flow of outlet liquid or a violent gush of the liquid from the mouth, was proposed. In this proposed liquid container, a mouth, normally sealed with a cap, is formed at a side of the container, while an air inlet opening is formed at the other side opposite to the mouth. When liquid is discharged from the leaned container through the open mouth, atmospheric air is separately introduced into the container through the air inlet opening, thus smoothly flowing into the container without encountering the outlet liquid. However, this liquid container is problematic in that it forces a manufacturer to separately form the air inlet opening on the container in addition to the mouth of the container during the process of producing the containers. This complicates the container production process and increases the production cost, and reduces productivity while producing liquid containers. Another problem of the container resides in that it fails to achieve a desired sealing effect for preserving the liquid in a fresh state. In addition, the liquid container, having such a separate air inlet opening in addition to the mouth, is limited in its application since it is very difficult to form such an air inlet opening on some containers having a narrow neck, such as bottles.

DISCLOSURE OF THE INVENTION

Accordingly, the present invention has been made keeping in mind the above problems occurring in the prior art, and an object of the present invention is to provide a cap for liquid containers, which is designed to allow liquid to be smoothly discharged from a liquid container through the mouth of the container while allowing atmospheric air to smoothly flow into the container through the mouth without encountering the discharged liquid.

Another object of the present invention is to provide a cap for liquid containers, which is designed to allow a user to selectively open the mouth of a liquid container to discharge liquid from the container through the mouth and to tightly close the mouth so as to achieve a desired sealing effect for preserving the liquid left within the container in a fresh state.

A further object of the present invention is to provide a cap for liquid containers, which is designed to allow some liquid, left around the mouth of a liquid container after a liquid discharging action, to be naturally recovered into the container by gravity.

In order to accomplish the above objects, the present invention provides a cap for liquid containers, comprising: a mounting part mounted to the mouth of a liquid container, the mounting part having a cylindrical shape with an internal thread and being tightened to an external thread formed on the mouth of the liquid container at the internal thread; a liquid discharging part extending from the top of the mounting part upwardly, and used for discharging liquid from the container, the liquid discharging part comprising a hollow cylindrical sidewall and a top wall integrated along the top edge of the cylindrical sidewall so as to cover the top of the sidewall, with a liquid outlet opening formed at a portion of the sidewall and an air inlet opening formed at another portion of the sidewall opposite to the liquid outlet opening, and a partition wall vertically extending from the lower surface of the top wall downward within the liquid discharging part, thus partitioning the interior of the liquid discharging part into a liquid passage and an air passage; and an openable top cover connected to a side of the mounting part, and used for covering and protecting the liquid discharging part.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
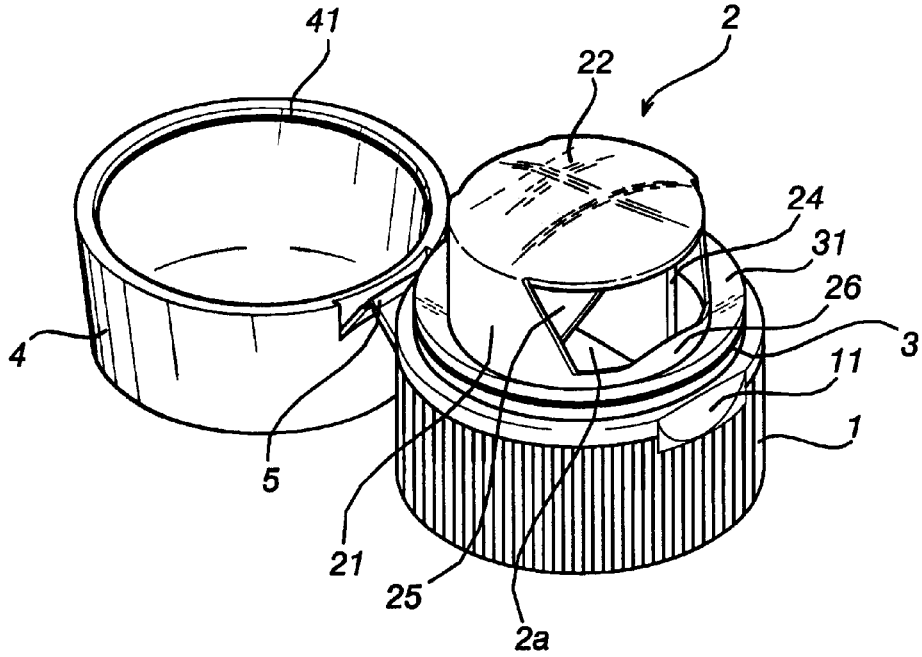
FIG. 1 is a front perspective view of a cap for liquid containers in accordance with the preferred embodiment of the present invention, when the openable top cover of the cap is opened from the cap body.
Figure 2:
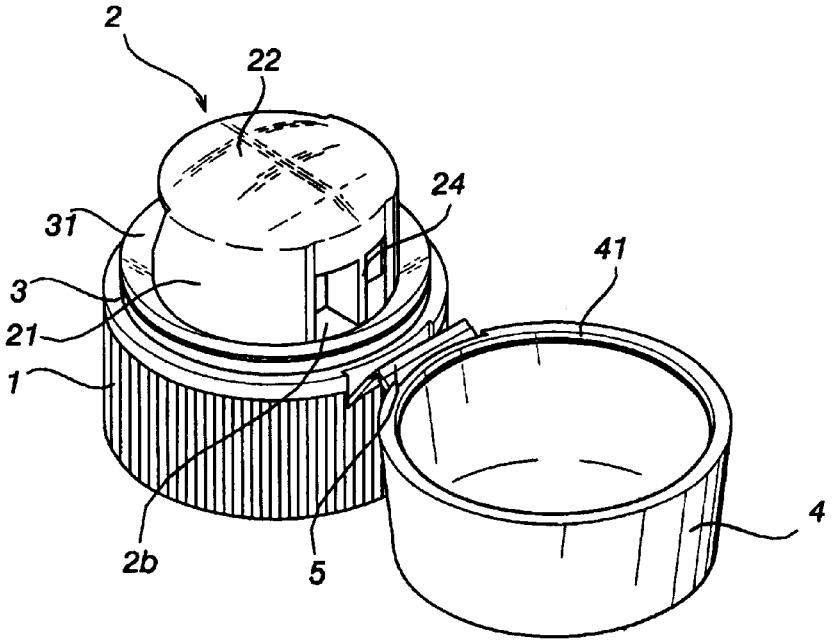
FIG. 2 is a rear perspective view of the cap according to the preferred embodiment of this invention.

Reference now should be made to the drawings, in which the same reference numerals are used throughout the different drawings to designate the same or similar components.

The accompanying drawings, FIGS. 1 to 6, show a cap for liquid containers in accordance with the preferred embodiment of the present invention. As shown in the drawings, the cap of this invention comprises three parts, that is, a mounting part 1, a liquid discharging part 2, and an openable top cover 4. The cap of this invention is mounted to the mouth of a liquid container at the mounting part 1. The liquid discharging part 2 extends from the top of the mounting part 1 upwardly, and is used for discharging liquid from the container. The openable top cover 4 is connected to a side of the mounting part 1, and is used for covering and protecting the liquid discharging part 2.

In the cap of this invention, the mounting part 1 is a cylindrical part with an internal thread 12, and so the part 1 is tightened to the externally-threaded mouth of the liquid container at the internal thread 12. The liquid discharging part 2 comprises a hollow cylindrical sidewall 21, and a top wall 22 integrated along the top edge of the sidewall 21 so as to cover the top of the sidewall 21. A liquid outlet opening 2*a* is formed at the front portion of the sidewall 21, while an air inlet opening 2*b* is formed at the rear portion of the sidewall 21 opposite to the liquid outlet opening 2*a*. A partition wall 23 vertically extends from the lower surface of the top wall 22 downward within the liquid discharging part 2, thus partitioning the interior of the part 2 into a liquid passage 2*a*' and an air passage 2*b*'.

The openable top cover 4 is rotatably connected to a side of the mounting part 1 by a snap hinge 5. The cover 4 is thus normally closed to cover the liquid discharging part 2, and is selectively opened to expose the part 2 to the atmosphere.

The outer diameter of the liquid discharging part 2 is smaller than that of the mounting part 1. A fitting ring 3 is externally formed around the junction between the mounting part 1 and the liquid discharging part 2, and closely engages with the lower edge 41 of the skirt of the top cover 4 when the cover 4 is fully closed. In such a case, the outer diameter of the fitting ring 3 is smaller that that of the mounting part 1, but is larger than that of the liquid discharging part 2. The upper surface 31 of the fitting ring 3 is linearly inclined downwardly from the outside edge to the inside edge, thus forming a sloped surface.

The sloped upper surface 31 of the fitting ring 3 continuously extends at its inside edge to the lower edge of the air inlet opening 2*b*, and so some liquid, left on the upper surface 31 at a time when the container is stood upright after liquid is discharged from the container through the liquid outlet opening 2*a*, naturally flows down the sloped upper surface 31 by gravity and is recovered into the container through the air inlet opening 2*b*.

The circular lower edge 41 of the skirt of the openable top cover 4 is slightly depressed along its interior surface, thus forming an annular seat having an inner diameter slightly larger than that of the remaining part of the skirt. The top cover 4 is thus closely fitted over the fitting ring 3 at the annular seat.

An inclined recess 11 is externally formed at the upper edge of the front portion of the mounting part 1, thus allowing the lower edge 41 of the top cover 4 to be partially exposed to the outside at a position above the recess 11, when the cover 4 is completely closed. Therefore, when it is desired to open the top cover 4, it is possible for a user's fingertip to easily reach the exposed part of the lower edge 41 through the recess 11 prior to levering the cover 4 up. The top cover 4 is thus easily opened.

The lower edge of the liquid outlet opening 2*a* is defined by the top edge of a liquid leading wall 26 extending upward from the inside edge of the sloped upper surface 31 of the fitting ring 3 to a predetermined height. The liquid leading wall 26 allows liquid to smoothly flow from the liquid outlet opening 2*a* without coming into contact with the fitting ring 3 during a liquid discharging action. The top edge of the liquid leading wall 26 is so rounded upwardly that its central portion is higher than opposite end portions. Therefore, it is possible to prevent an undesired concentration of liquid toward the central portion of the top edge of the liquid leading wall 26 when the liquid flows out of the liquid outlet opening 2*a* during a liquid discharging action.

Three liquid guide walls 24 and 25 vertically extend from the lower surface of the top wall 22 downward within the liquid discharging part 2 in such a way that they are perpendicular to the partition wall 23. The three liquid guide walls 24 and 25 smoothly guide liquid currents within the liquid discharging part 2 before the liquid is discharged from the part 2 through the liquid outlet opening 2*a*. Of the three guide walls 24 and 25, the central one 24 has a rectangular profile and is integrated with the fitting ring 3, thus enhancing the structural strength of the liquid discharging part 2. On the other hand, the two outside guide walls 25 individually have a triangular profile, with the horizontal side of each triangular guide wall 25 integrated with the top wall 22, the vertical side extending in parallel to the surface of the partition wall 23, and the inclined side suspended within the interior of the liquid discharging part 2.

Figure 3:
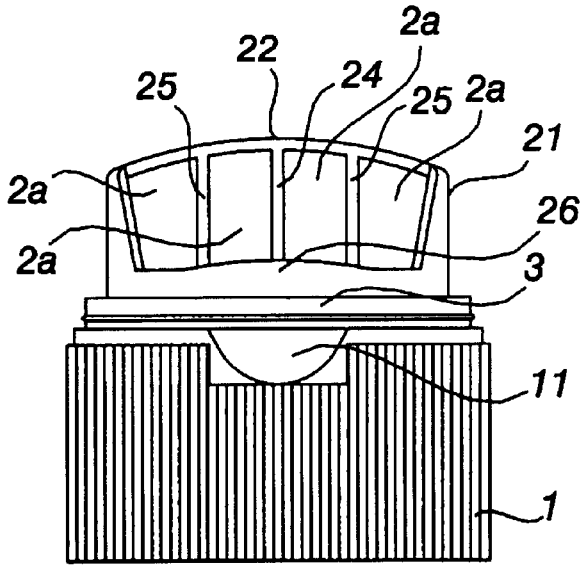
FIG. 3 is a front view of the cap according to the preferred embodiment of this invention.
Figure 4:
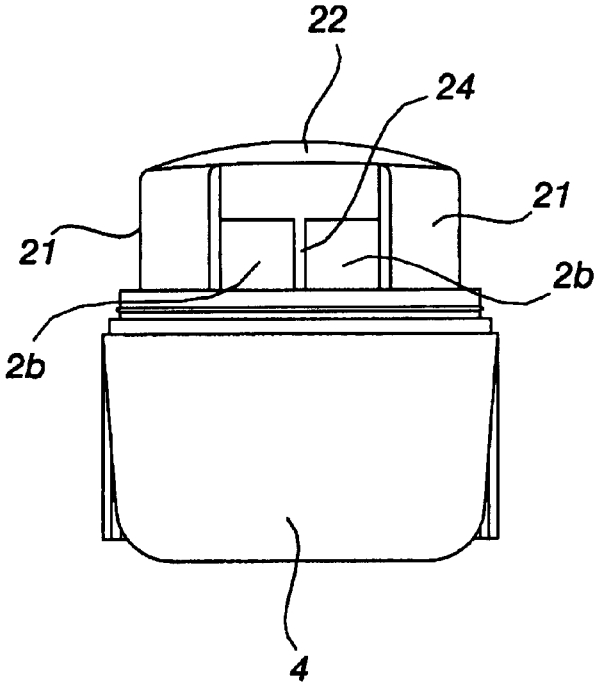
FIG. 4 is a rear view of the cap according to the preferred embodiment of this invention.
Figure 5:
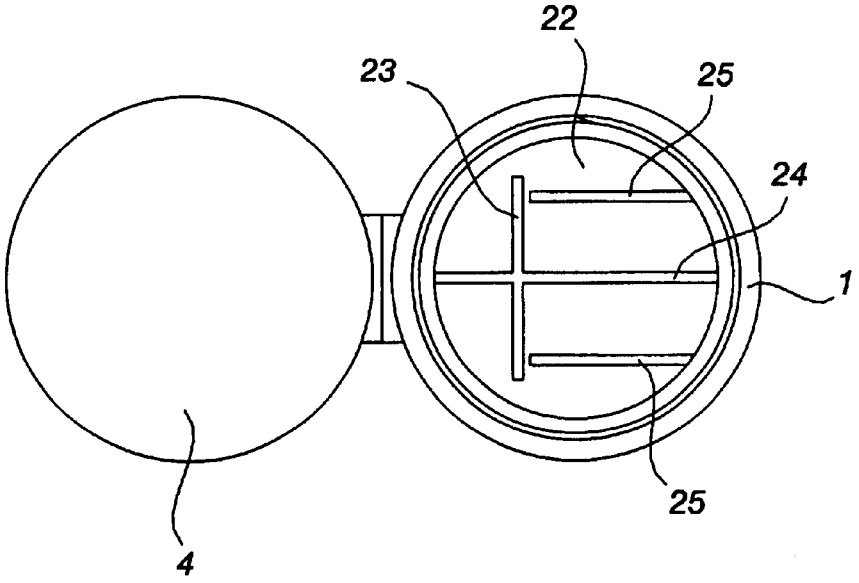
FIG. 5 is a bottom view of the cap according to the preferred embodiment of this invention.
Figure 6:
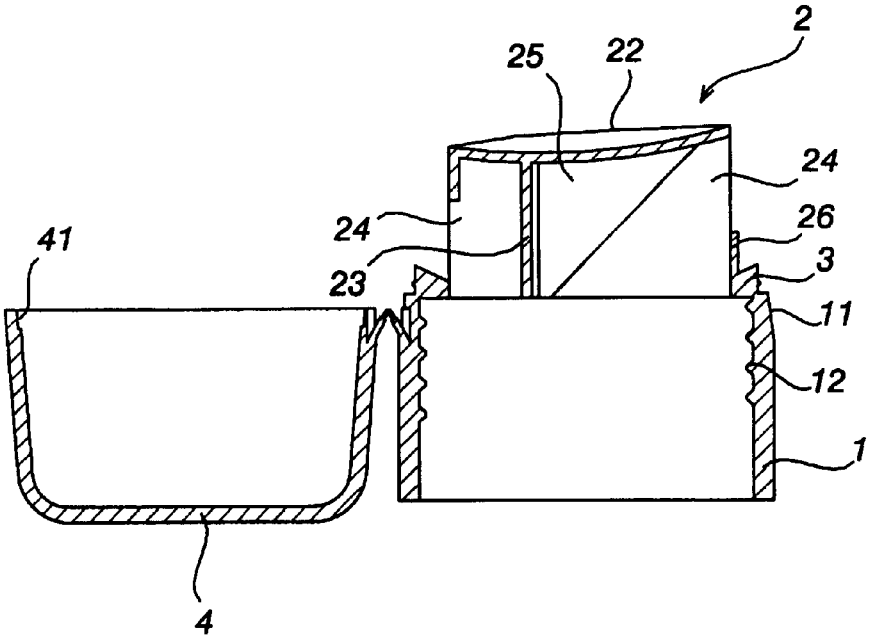
FIG. 6 is a partially sectioned view of the cap according to the preferred embodiment of this invention.

As best seen in FIGS. 3 and 6, the top wall 22 of the liquid discharging part 2 slopes up in a direction toward the central portion of the upper edge of the liquid outlet opening 2*a*. Opposite side edges of the liquid outlet opening 2*a* are linearly inclined in such a way that the horizontal width of the opening 2*a* is gradually reduced in a direction from the top to the bottom as best seen in FIGS. 1 and 3. Due to such a profile of the liquid outlet opening 2*a*, liquid converges to the center of the opening 2*a* and smoothly flows out of the opening 2*a* into a desired cup.

Figure 7:
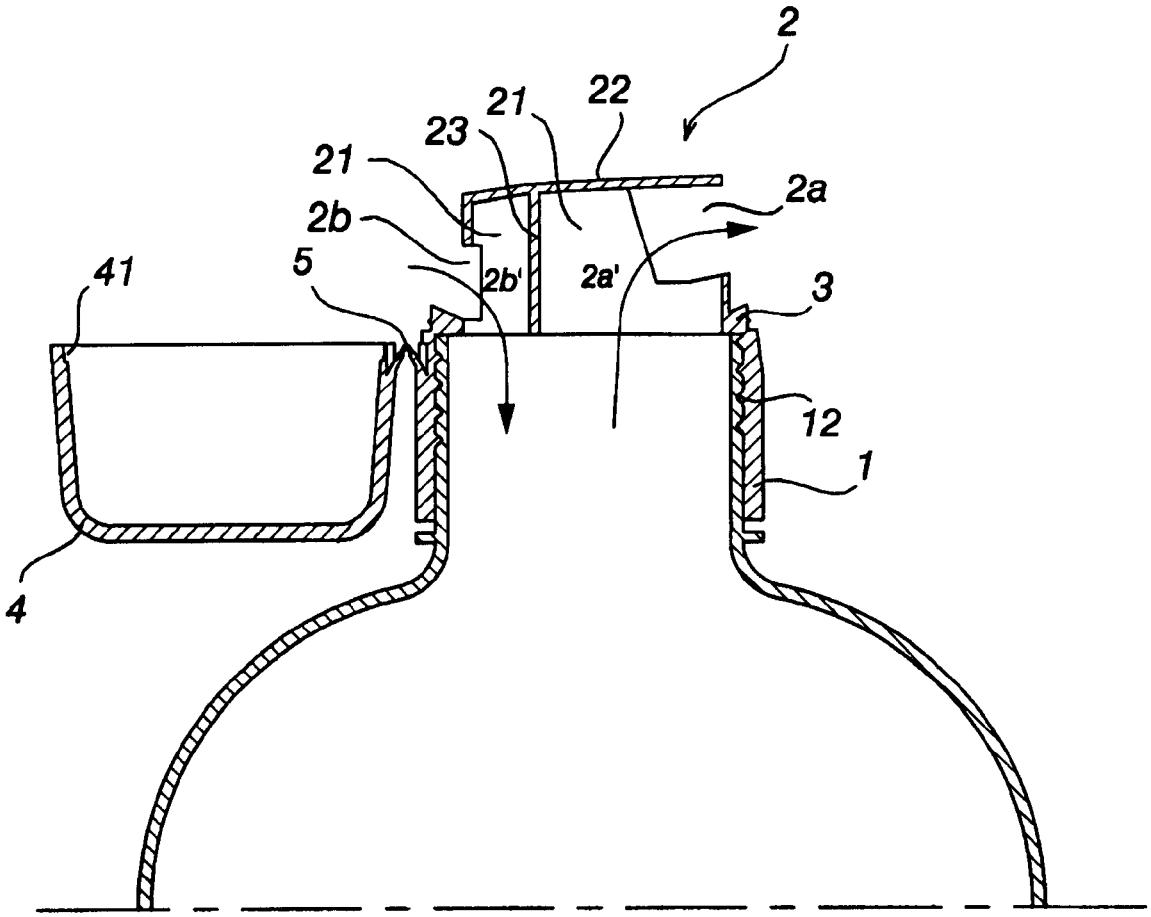
FIG. 7 is a sectional view, showing the cap according to the preferred embodiment of this invention set on the mouth of a liquid container, with the liquid guide walls removed from the cap for ease of description.

FIG. 7 is a sectional view, showing the cap according to the preferred embodiment of this invention set on the mouth of an upright standing liquid container, with the liquid guide walls 24 and 25 removed from the cap for ease of description. When the container is properly leaned to the right in the drawing after opening the top cover 4, liquid in the container flows through the liquid passage 2*a*' prior to being discharged from the liquid outlet opening 2*a* into a desired cup. During such a liquid discharging action, atmospheric air is introduced into the container through the air inlet opening 2*b* and the air passage 2*b*' so as to compensate for the negative pressure within the container. In such a case, the inlet air current does not encounter the outlet liquid, and so the liquid is smoothly discharged from the container without unevenly flowing or violently gushing from the mouth of the container.

INDUSTRIAL APPLICABILITY

As described above, the present invention provides a cap for liquid containers. This cap comprises a mounting part, a liquid discharging part, and an openable top cover. The cap is easily and firmly mounted to the mouth of a liquid container at the mounting part. The liquid discharging part extends from the top of the mounting part upwardly, and is used for discharging liquid from the container. The openable top cover is connected to a side of the mounting part, and is used for covering and protecting the liquid discharging part. The interior of the liquid discharging part is partitioned into a liquid passage and an air passage by a partition wall, and is provided with a liquid outlet opening communicating with the liquid passage and an air inlet opening communicating with the air passage. When the liquid is discharged from the container through the liquid outlet opening, atmospheric air is introduced into the container through the air inlet opening to compensate for negative pressure within the container. The cap thus allows liquid to be smoothly discharged from the container without unevenly flowing or violently gushing from the mouth of the container. A fitting ring 3 is formed around the junction between the mounting part and the liquid discharging part, and closely engages with the lower edge of the skirt of the top cover when the cover is fully closed. It is thus possible for the top cover to firmly and stably cover the liquid discharging part and to protect the liquid discharging part from the outside.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A cap for a liquid container, comprising:

a mounting part mountable to a mouth of the liquid container, sad mounting part having a cylindrical shape with an internal thread and being engageable with an external thread formed on the mouth of said liquid container at said internal thread;

a liquid discharging part extending from a top of said mounting part upwardly, and used for discharging liquid from the container, said liquid discharging part comprising a hollow cylindrical sidewall and a top wall integrated along a top edge of said cylindrical sidewall so as to cover the top of said sidewall, with a liquid outlet opening formed at a portion of said sidewall and an air inlet opening formed at another portion of said sidewall opposite to the liquid outlet opening, and a partition wall vertically extending from a lower surface of said top wall downward within the liquid discharging part, thus partitioning the interior of said liquid discharging part into a liquid passage and an air passage; and an openable top cover connected to a side of said mounting part, and used for covering and protecting said liquid discharging part, said liquid discharging part having an outer diameter smaller than that of said mounting part, with a fitting ring externally formed around the junction between said mounting part and said liquid discharging part and being used for engaging with a lower edge of a skirt of said openable top cover when the top cover is closed, said fitting ring having an outer diameter smaller than that of said mounting part, but larger than that of said liquid discharging part, an upper surface of said fitting ring being inclined downwardly from an outside edge to an inside edge, thus forming a sloped surface.

2. The cap according to claim 1, wherein said sloped upper surface of the fitting ring continuously extends at its inside edge to a lower edge of said air inlet opening.

3. The cap according to claim 1, wherein said lower edge of the skirt of the openable top cover is depressed along its interior surface, thus forming an annular seat having an inner diameter larger than that of a remaining part of said skirt, said top cover being thus fitted over the fitting ring at said annular seat.

4. The cap according to claim 1, wherein a liquid leading wall extends upward from an inside edge of said fitting ring to a predetermined height, thus defining a lower edge of said liquid outlet opening at its top edge.

5. The cap according to claim 1, wherein said liquid outlet opening is inclined at opposite side edges thereof in such a way that the liquid outlet opening has a horizontal width gradually reduced in a direction from the top to the bottom.

6. A cap for a liquid container, comprising:

a mounting part mountable to a mouth of the liquid container, said mounting part having a cylindrical shape with an internal thread and being engageable with an external thread formed on the mouth of said liquid container at said internal thread;

a liquid discharging part extending from a top of said mounting part upwardly, and used for discharging liquid from the cone, said liquid discharging part comprising a hollow cylindrical sidewall and a top wall integrated along a top edge of said cylindrical sidewall so as to cover the top of said sidewall, with a liquid outlet opening formed at a portion of said sidewall and an air inlet opening formed at another portion of said sidewall opposite to the liquid outlet opening, and a partition wall vertically extending from a lower surface of said top wall downward within the liquid discharging part, thus partitioning the interior of said liquid discharging part into a liquid passage and an air passage; and an openable top cover connected to a side of said mounting part, and used for covering and protecting said liquid discharging part, an inclined recess being externally formed at a predetermined position of an upper edge of said mounting part, thus allowing the lower edge of said openable top cover to be partially exposed to the outside at a position above the inclined recess when the cover is closed.

7. A cap for a liquid container, comprising:

a mounting part mountable to a mouth of the liquid container, said mounting part having a cylindrical shape with an internal thread and being engageable with an external thread formed on the mouth of said liquid container at said internal thread;

a liquid discharging part extending from a top of said mounting part upwardly, and used for discharging liquid from the container, said liquid discharging part comprising a hollow cylindrical sidewall and a top wall integrated along a top edge of said cylindrical sidewall so as to cover the top of said sidewall, with a liquid outlet opening formed at a portion of said sidewall and an air inlet opening formed at another portion of said sidewall opposite to the liquid outlet opening, and a partition wall vertically extending from a lower surface of said top wall downward within the liquid discharging part, thus partitioning the interior of said liquid discharging part into a liquid passage and an air passage; and an openable top cover connected to a side of said mounting part, and used for covering and protecting said liquid discharging part, said liquid discharging part having an outer diameter smaller than that of said mounting part, with a fitting ring externally formed around the junction between said mounting part and said liquid discharging part and being used for engaging with a lower edge of a skirt of said openable top cover when the top cover is closed, said fitting ring having an outer diameter smaller than that of said mounting part, but larger than that of said liquid discharging part, a liquid leading wall extends upward from an inside edge of said fitting ring to a predetermined height, thus defining a lower edge of said liquid outlet opening at its top edge, wherein the top edge of said liquid leading wall is so rounded upwardly that its central portion is higher than opposite end portions.

8. A cap for a liquid container, comprising:

a mounting part mountable to a mouth of the liquid container, said mounting part having a cylindrical shape with an internal thread and being engageable with an external thread formed on the mouth of said liquid container at said internal thread;

a liquid discharging part extending from a top of said mounting part upwardly, and used for discharging liquid from the container, said liquid discharging part comprising a hollow cylindrical sidewall and a top wall integrated along a top edge of said cylindrical sidewall so as to cover the top of said sidewall, with a liquid outlet opening formed at a portion of said sidewall and an air inlet opening formed at another portion of said sidewall opposite to the liquid outlet opening, and a partition wall vertically extending from a lower surface of said top wall downward within the liquid discharging part, thus partitioning the interior of said liquid discharging part into a liquid passage and an air passage, one or more liquid guide walls vertically extending from the lower surface of said top wall of the liquid discharging part downward in such a way that said liquid guide walls are perpendicular to said partition wall, said liquid guide walls being used for guiding liquid flowing in the liquid discharging part before the liquid is discharged from said liquid outlet opening; and an openable top cover connected to a side of said mounting part, and used for covering and protecting said liquid discharging part.

9. The cap according to claim 8, wherein said liquid guide walls comprise one central guide wall integrated with a lower part of the sidewall of said liquid discharging part at its lower portion, and two outside guide walls positioned outside the central guide wall and individually having a triangular profile, with a horizontal side of each of said triangular outside guide walls integrated with the top wall of the liquid discharging part, a vertical side extending in parallel to said partition wall, and an inclined side suspended within the interior of said liquid discharging part.

10. A cap for a liquid container, comprising:

a mounting part mountable to a mouth of the liquid container, said mounting part having a cylindrical shape with an internal thread and being engageable with an external thread formed on the mouth of said liquid container at said internal thread;

a liquid discharging part extending from a top of said mounting part upwardly, and used for discharging liquid from the container, said liquid discharging part comprising a hollow cylindrical sidewall and a top wall integrated along a top edge of said cylindrical sidewall so as to cover the top of said sidewall, with a liquid outlet opening formed at a portion of said sidewall and an air inlet opening formed at another portion of said sidewall opposite to the liquid outlet opening, and a partition wall vertically extending from a lower surface of said top wall downward within the liquid discharging part, thus partitioning the interior of said liquid discharging part into a liquid passage and an air passage; and an openable top cover connected to a side of said mounting part, and used for covering and protecting said liquid discharging part, wherein said top wall of the liquid discharging part slopes up in a direction toward a central portion of an upper edge of said liquid outlet opening.

* * * * *